US005609048A

United States Patent [19]

Ling

[11] Patent Number: 5,609,048

[45] Date of Patent: Mar. 11, 1997

[54] PIVOTALLY LOCKABLE AND SEESAWLY RESTORABLE COMBINATION PADLOCK

[76] Inventor: Chong-Kuan Ling, c/o Sinox Co., Ltd. P.O. Box 96-156, Taipei, Taiwan

[21] Appl. No.: 633,678

[22] Filed: Apr. 17, 1996

[51] Int. Cl.[6] ..... E05B 37/14

[52] U.S. Cl. ..... 70/28; 70/312

[58] Field of Search ..... 70/27–29, 312

[56] References Cited

U.S. PATENT DOCUMENTS

| | | | |
|---|---|---|---|
| 486,420 | 11/1892 | Abbott | 70/28 |
| 1,123,061 | 12/1914 | Alanchikoff | 70/28 |
| 4,803,856 | 2/1989 | Ling | 70/28 |
| 4,866,959 | 9/1989 | Ling | 70/312 X |
| 5,193,367 | 3/1993 | Ling | 70/28 |
| 5,359,867 | 11/1994 | Ling et al. | 70/28 |
| 5,396,785 | 3/1995 | Chen | 70/312 X |

FOREIGN PATENT DOCUMENTS

| | | | |
|---|---|---|---|
| 352886 | 5/1922 | Germany | 70/29 |
| 145313 | 7/1920 | United Kingdom | 70/29 |

*Primary Examiner*—Lloyd A. Gall

[57] ABSTRACT

A combination padlock includes: a housing rotatably mounted with a plurality of dials and sleeves in the housing, a shackle having a pivotal end portion pivotally secured on a pivotal portion of the housing and having a locking end portion of the shackle lockable in a locking cavity formed in the housing opposite to the pivotal portion, and a combination-changing device having an actuating plunger reciprocatively held in the housing and depressible for retaining the sleeves for free rotation of the dials after the lock is unlocked for changing a combination and a seesaw lever respectively engageable with the pivotal end portion of the shackle and engageable with the actuating plunger, whereby upon closing and locking of the shackle on the housing, the locking end portion of the shackle will be locked by a latch as controlled by a control plate slidably held in the housing as driven by the sleeves and dials; and the pivotal end portion of the shackle will bias the seesaw lever to simultaneously restore the actuating plunger upwardly automatically ready for a next depression for further changing a combination of the padlock.

5 Claims, 3 Drawing Sheets

PIVOTALLY LOCKABLE AND SEESAWLY RESTORABLE COMBINATION PADLOCK

BACKGROUND OF THE INVENTION

U.S. Pat. No. 5,193,367 to the same inventor of this application disclosed a combination padlock with sidewardly pivoted hasp which is engaged with a hasp fastening member for locking the padlock. However, such a conventional padlock may have the following drawbacks:

1. When it is locked, the lower or base portion of the hasp (5) is held on the head portion (23) of the locking bolt (5). If upon a biasing operation of the hasp (5) about the pivot (17) such as by an intruder or a thief the lower portion of hasp (5) will urge the locking bolt (2) to force each protrusion (22) of The bolt (2) upon each sleeve (4), thereby giving sense of feeling helpful for trying to locate the protrusion notch (42) longitudinally formed through each sleeve (4) in order for unlocking the lock.

2. For changing combination of the lock, the cylindrical lock (61) should be depressed inwardly in the lock body 1 and then rotated to be locked inside the lock body for retaining the sleeves after unlocking the lock as shown in FIG. 1*c*, causing inconvenience for the user. After finishing the change of combination, the block 61 should be reversely rotated and restored to its outwardly extended position, also causing inconvenience.

The present inventor has found the drawbacks of the conventional combination padlock and invented the present combination padlock having sophisticated locking mechanism uneasy to unlock it by trial-and-error; and also having a seesaw mechanism to automatically restore the combination-changing device when locking the shackle of the padlock.

SUMMARY OF THE INVENTION

The object of the present invention is to provide a combination padlock including: a housing rotatably mounted with a plurality of dials and sleeves in the housing, a shackle having a pivotal end portion pivotally secured on a pivotal portion of the housing and having a locking end portion of the shackle lockable in a locking cavity formed in the housing opposite to the pivotal portion, and a combination-changing device having an actuating plunger reciprocatively held in the housing and depressible for retaining the sleeves for free rotation of the dials after the lock is unlocked for changing a combination and a seesaw lever respectively engageable with the pivotal end portion of the shackle and engageable with the actuating plunger, whereby upon closing and locking of the shackle on the housing, the locking end portion of the shackle will be locked by a latch as controlled by a control plate slidably held in the housing as driven by the sleeves and dials; and the pivotal end portion of the shackle will bias the seesaw lever to simultaneously restore the actuating plunger upwardly automatically ready for a next depression for further changing a combination of the padlock.

DETAILED DESCRIPTION

Figure 1:
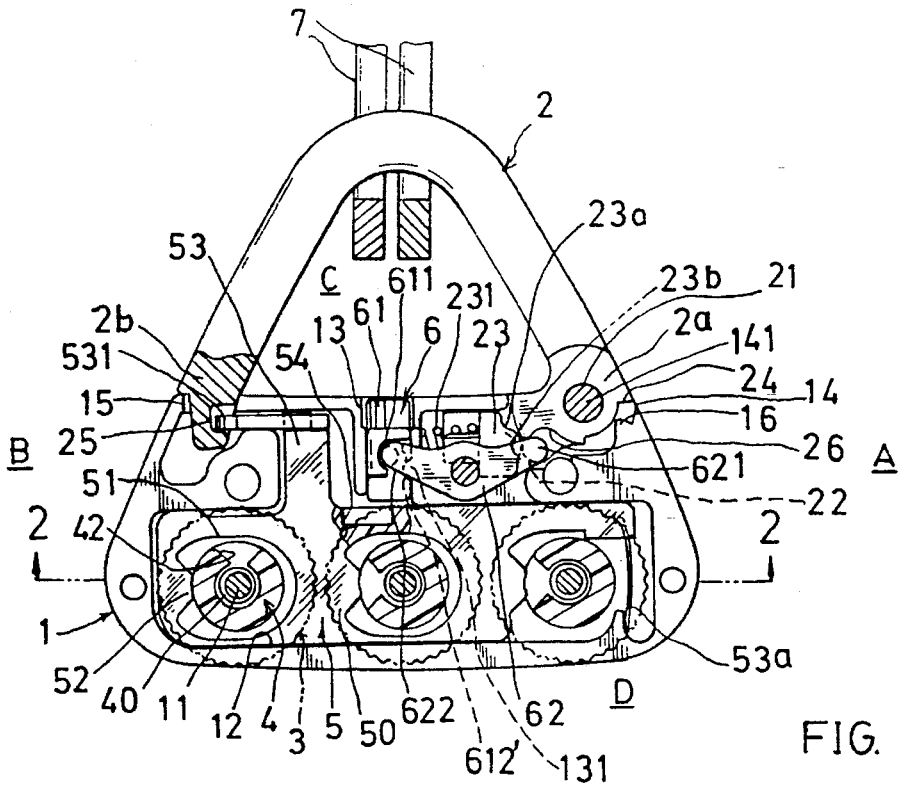
FIG. 1 is a sectional drawing of the present invention when locked.

As shown in the drawing figures, a preferred embodiment of combination padlock in accordance with the present invention comprises: a housing 1, a shackle 2 pivotally secured on the housing 1 for locking the padlock on a pair of fastening straps 7 or other articles to be locked, a plurality of dials 3 and sleeves 4 resiliently rotatably mounted in the housing 1, a control plate 5 slidably held in the housing 1, and a combination-changing means 6 mounted in the housing 1 for re-setting a new combination for the padlock.

Although the shape of the padlock is triangular shaped as shown in the drawing figures, other shapes of the padlock and the arrangements of the elements in construction of the present invention may be further modified by those skilled in the art, not limited in the present invention.

Figure 2:
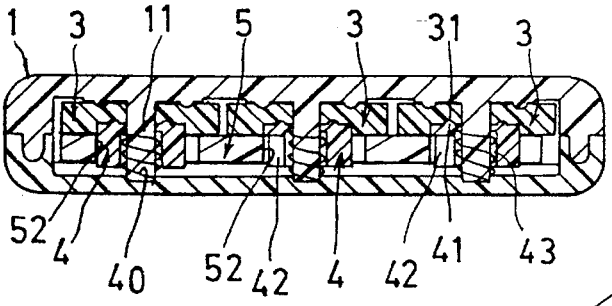
FIG. 2 is a cross sectional drawing of the present invention as viewed from 2—2 direction of FIG. 1.

The housing 1 may be combined by a pair of half shells and includes: a plurality of stems 11 for rotatably mounting the dials 3 and sleeves 4 at a dialing side D of the housing 1 as shown in FIG. 2, a sliding cavity 12 longitudinally formed in the housing 1 for slidably holding the control plate 5 in the sliding cavity 12, a plunger cavity 13 formed in an upper portion of the housing 1 perpendicularly communicated with the sliding cavity 12 and positioned at an actuating side C of the housing 1 for reciprocatively holding an actuating plunger 61 of the combination-changing means 6, a pivotal portion 14 having a pivot 141 provided at a pivotal side A of the housing 1 for pivotally securing the shackle 2 thereon, a locking cavity 15 recessed in a locking side B of the housing 1 for engaging a locking end portion 2*b* of the shackle 2, and a stopping tooth 16 formed in the pivotal portion 14 for limiting an opening movement of the shackle when unlocking the padlock.

Each dial 3 is formed with a plurality of recesses 31 annularly in the dial 3, and each sleeve 4 is formed with a plurality of protrusions 41 annularly in the sleeve 4 to be engageable with the recesses 31 in each dial 3 for rotatably engaging each dial 3 with each sleeve 4 on the stem 11 as tensioned by a tension spring 40 for resiliently coupling each dial 3 with each sleeve 4. Each sleeve 4 is formed with a notch 42 tapered inwardly to communicate with a central hole 43 formed through the sleeve 4 with the central hole 43 engageable with the stem 11 as shown in FIG. 2.

The shackle 2 generally formed as an inversed V shape includes: a pivotal end portion 2*a* having a pivot hole 21 formed therein for engaging the pivot 141 on the housing 1, a cam portion 22 arcuately formed on the pivotal end portion 2*a* of the shackle 2, a block member 23 having an upper and a lower engaging portion 23*a*, 23*b* formed on the block member 23 for selectively engaging the cam portion 22 of the pivotal end portion 2*a* as urged by a tensioning spring 231 retained in the housing 1, a pawl 24 formed on a lower portion of the pivotal end portion 2*a* to be limited by the stopping tooth 16 formed in the housing 1, a shackle biasing recess 26 recessed in the pivotal end portion 2*a* to be engaged with a lever end 621 of the seesaw lever 62 of the combination-changing means 6, and a locking end portion 2*b* opposite to the pivotal end portion 2*a* and having a locking recess 25 recessed in the locking end portion 2b for engaging a latch 531 on the control plate 5 for locking the shackle 2 on the housing 1.

The control plate 5 slidably held in the sliding cavity 12 in the housing 1 includes: a plurality of slots 51 each slot 51 larger than each sleeve 4 to be slidably engageable with each sleeve 4, each slot 51 having a taper extension 52 formed on a perimeter of the slot 51 and engageable with each notch 42 tapered in each sleeve 4 when the padlock is locked, each taper extension 52 being outwardly thrusted and disengaged from each notch 42 in the sleeve 4 to thereby push the control plate from a pivotal side A towards a locking side B of the housing 1 when the padlock is locked as shown in FIG. 1, a latch 531 secured (or formed) on an upper portion of a pushing member 53 perpendicularly formed on the control plate 5 for engaging the locking recess 25 formed in the locking end portion 2b of the shackle 2 when locking the padlock, a restoring spring 53a retained in the housing i and normally urging the control plate 5 towards the pivotal side A of the housing 1 for engaging each taper extension 52 on the control plate 5 with each notch 42 formed in each sleeve 4 when unlocking the padlock, and a plunger recess 54 recessed in an upper portion of the control plate 5 for engaging the actuating plunger 61 of the combination-changing means 6 when unlocking the padlock for re-setting a new combination.

The combination-changing means 6 formed on the actuating side C of the housing 1 includes: an actuating plunger 61 reciprocatively held in the plunger cavity 13 recessed in the actuating side C of the housing 1, and a seesaw lever 62 pivotally mounted in the housing 1 and having a first lever end 621 engageable with a shackle biasing recess 26 recessed in the pivotal end portion 2a of the shackle 2 and a second lever end 622, opposite to the first lever end 621 engageable with a biasing recess 611 recessed in a middle portion of the actuating plunger 61, an upper and a lower positioning notch 612, 612' successively recessed n a side portion of the plunger 61 with each notch (612 or 612') engageable with a protrusion 131 formed in the plunger cavity 13 in the housing 1, a through opening 613 transversely formed in the plunger 61 for thinning the thickness between the opening 613 and each notch (612 or 612') for resiliently engaging each notch (612 or 612') with the protrusion 131 in the plunger cavity 13 and a plunger bottom 614 formed on a lowest portion of the plunger 61 to be engageable with a plunger recess 54 recessed in the control plate 5 when downwardly depressing the actuating plunger 61 for changing combination of the padlock.

When locking the present invention as shown in FIG. 1, the dials 3 and sleeves 4 are rotated to thrust the control plate 5 towards the locking side B of the housing 1 to engage the latch 531 with the locking recess 25 recessed in the locking end portion 2b of the shackle 2 to lock the shackle 2 into the housing 1.

Figure 3:
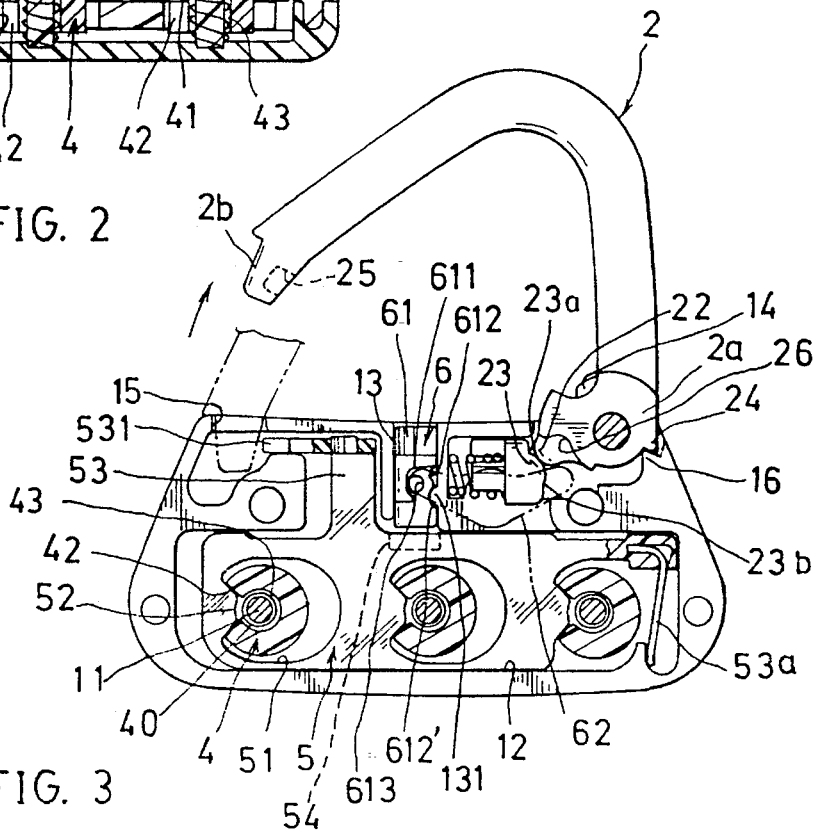
FIG. 3 is a sectional drawing of the present invention when unlocked.

When unlocking the present invention as shown in FIG. 3 by correctly rotating the dials and sleeves to match each extension 52 of the control plate 5 with each notch 42 of the sleeve 4, the control plate 5, as restored by the restoring spring 53a normally urging the control plate 5 towards the pivotal side A of the housing, will retract the latch 531 to disengage from the locking recess 25 of the shackle 2, thereby allowing the opening of the shackle 2 as an arrow shown in FIG. 3.

The pivotal opening of the pivotal end portion 2a of the shackle 2 will also rotate the cam portion 22 to engage the upper engaging portion 23a of the block member 23 resiliently urged by the spring 231 for obtaining a sensible feeling as the shackle 2 is really unlocked as shown in FIG. 3.

The pawl 24 on the pivotal end portion 2a will be braked by the stopping tooth 16 formed in the housing 1 for stably opening the shackle 2 for unlocking the padlock of the present invention (FIG. 3).

Figure 4:
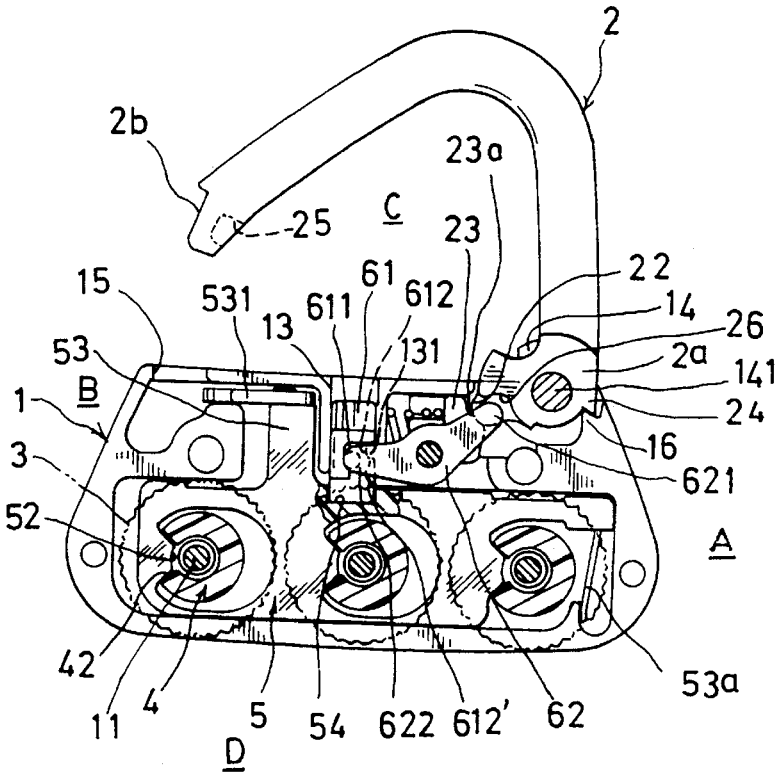
FIG. 4 is an illustration for changing a combination when depressing the actuating plunger of the combination-changing means of the present invention as being unlocked.

For changing a new combination as shown in FIG. 4, the actuating plunger 61 is downwardly depressed by an external object to engage the upper positioning notch 612 with the protrusion 131 in the plunger cavity 13, and the first lever end 622 (as engaged with the biasing recess 611 in the plunger 61) of the seesaw lever 62 will be depressed downwardly to bias the second lever end 621 of the seesaw lever 62 upwardly to approximate the shackle biasing recess 26 in the shackle 2, and the plunger bottom 614 is engaged into the plunger recess 54 in the control plate 5, thereby restricting the control plate 5 from its sliding movement in the socket 12 for "locking" the sleeves 4 for a free rotation of the dials for changing a new combination.

Figure 5:
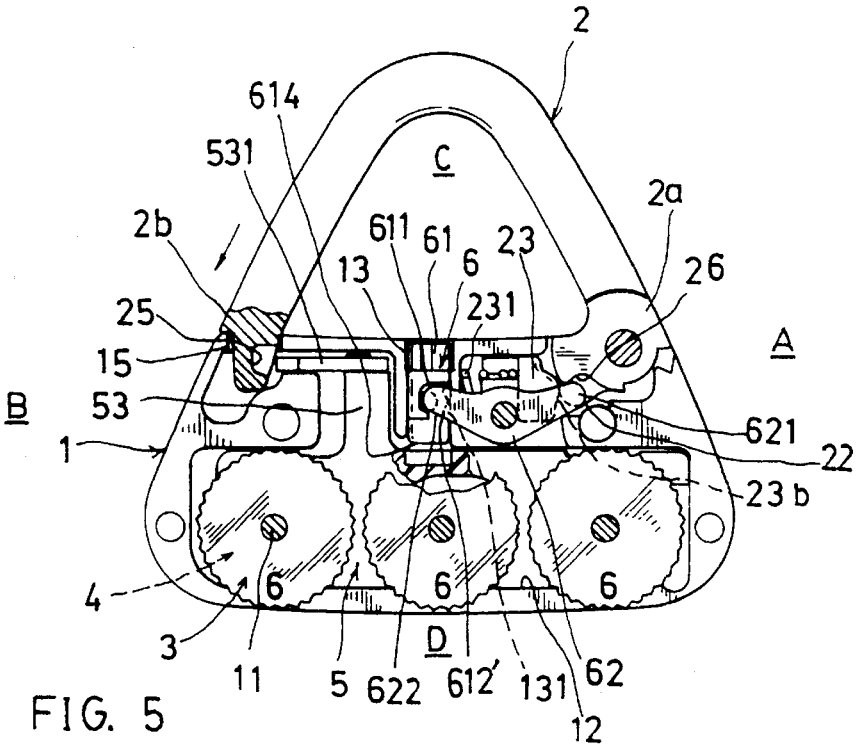
FIG. 5 shows a restored condition of the combination-changing means after closing and locking the shackle of the present invention from FIG. 4.
Figure 6:
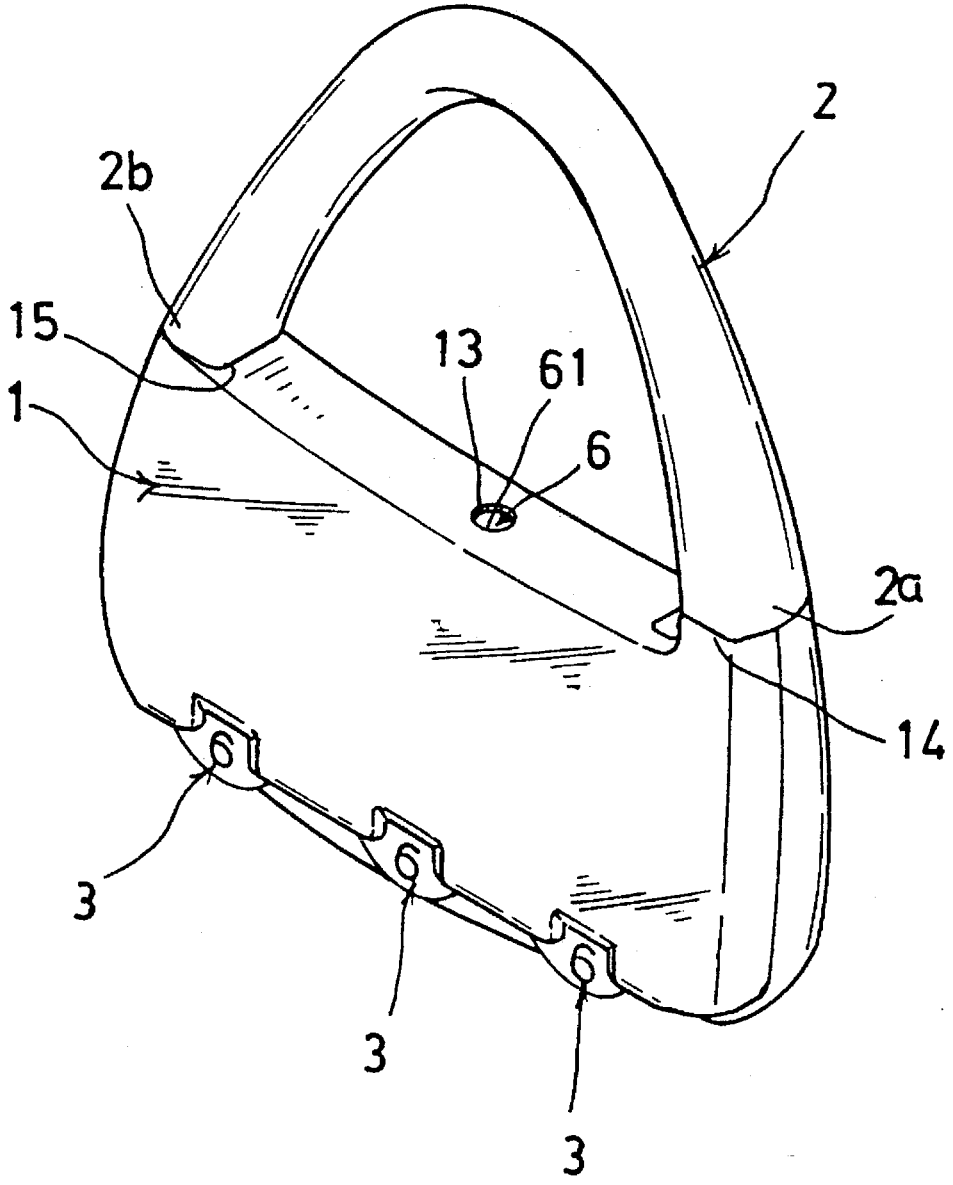
FIG. 6 is a perspective view of the present invention.

After finishing the combination change, the shackle 2 may be closed to the housing 1 as shown in FIG. 5, the pivotal end portion 2a of the shackle 2 will depress the second lever end 621 of the seesaw lever 62 from FIG. 4 to FIG. 5 to bias the plunger 61 upwardly, thereby automatically restoring the actuating plunger 61 from its downward retracted position to an upward restoring ready for next depression The cam portion 22 of the shackle 2 is now engaged with the lower engaging portion 23b of the block member 23 as urged by the spring 231 for stabilizing the shackle 2 at its locked state and also for obtaining a sense of feeling by the user indicating the shackle now being closed to the housing 1. By rotating the dials and sleeves from FIG. 5 to FIG. 1 to move the control plate 5 to re-engage the latch 531 with the locking recess 25 in the shackle, the padlock will become locked.

The present invention is superior to a conventional combination padlock with the following advantages:

1. The locking end portion 2b of the shackle 2 is locked by the latch 531 secured to the pushing member 53 of the control plate 5, without a direct contact with the control plate 5; while the pivotal end portion 2a of the shackle 2 is pivotally secured to the housing without touching the control plate 5, thereby minimizing the opportunity or probability to unlock the padlock by an intruder or a thief by sense of feeling.

2. Upon closing the shackle 2 from its opening and unlocked state to the housing after resetting operation, the actuating plunger 61 of the combination-changing means 6 will be automatically restored, ready for next operation for resetting a new combination by the seesaw lever 62 respectively engageable with the plunger 61 and the pivotal end portion 2a of the shackle 2. Therefore, a convenient resetting of the combination lock can be achieved.

I claim:

1. A combination padlock comprising:

a housing having a pivotal portion disposed at a pivotal side of said housing, and a locking cavity recessed in said housing at a locking side opposite to said pivotal side;

a shackle having a pivotal end portion pivotally secured to the pivotal portion of said housing, and a locking end portion of said shackle lockable in said locking cavity in said housing;

a plurality of dials and sleeves rotatably mounted in said housing;

a control plate slidably held in said housing and operatively lockable with said locking end portion of said shackle as rotatably driven by said sleeves and said dials for locking said padlock; and a combination-changing means having an actuating plunger reciprocatively held in said housing and operatively depressible for limiting movement of said control plate and stopping rotation of said sleeves when said padlock is unlocked for free rotation of said dials for resetting a new combination, and a seesaw lever having two opposite lever ends of said lever respectively engageable with said actuating plunger and said pivotal end portion of said shackle, whereby upon a pivotal movement of said shackle to lock said housing and to depress one said lever end of said seesaw lever, the actuating plunger will be biased upwardly by the other lever end of said seesaw lever for automatically restoring the plunger of the combination-changing means.

2. A combination padlock according to claim 1, wherein said shackle includes: said pivotal end portion having a pivot hole formed therein for engaging a pivot formed in the housing, a cam portion arcuately formed on the pivotal end portion of the shackle, a block member having an upper and a lower engaging portion formed on the block member for selectively engaging the cam portion of the pivotal end portion as urged by a tensioning spring retained in the housing, a pawl formed on a lower portion of the pivotal end portion to be limited by a stopping tooth formed in the housing, a shackle biasing recess recessed in the pivotal end portion to be engaged with a lever end of the seesaw lever of the combination-changing means, and said locking end portion opposite to the pivotal end portion and having a locking recess recessed in the locking end portion for engaging a latch formed on the control plate for locking the shackle on the housing.

3. A combination padlock according to claim 1, wherein said control plate is slidably held in a sliding cavity formed in the housing and includes: a plurality of slots each said slot larger than each said sleeve to be slidably engageable with each said sleeve, each said slot having a taper extension formed on a perimeter of the slot and engageable with a notch tapered in each said sleeve when the padlock is locked, each said taper extension being outwardly thrusted and disengaged from each said notch in the sleeve to thereby push the control plate from said pivotal side towards said locking side of the housing when the padlock is locked, a latch formed on an upper portion of a pushing member perpendicularly formed on the control plate for engaging a locking recess formed in the locking end portion of the shackle when locking the padlock, a restoring spring retained in the housing and normally urging the control plate towards the pivotal side of the housing for engaging each said taper extension on the control plate with each said notch formed in each said sleeve when unlocking the padlock, and a plunger recess recessed in an upper portion of the control plate for engaging the actuating plunger of the combination-changing means when unlocking the padlock for re-setting a new combination.

4. A combination padlock according to claim 1, wherein said combination-changing means includes: said actuating plunger reciprocatively held in a plunger cavity recessed in the housing, and said seesaw lever pivotally mounted in the housing and having a first lever end engageable with a shackle biasing recess recessed in the pivotal end portion of the shackle and a second lever end, opposite to the first lever end, engageable with a biasing recess recessed in a middle portion of the actuating plunger, and a plunger bottom formed on a lowest portion of the plunger to be engageable with a plunger recess recessed in the control plate when downwardly depressing the actuating plunger for changing combination of the padlock.

5. A combination padlock according to claim 4, wherein said actuating plunger is formed with an upper and a lower positioning notch successively recessed in a side portion of the plunger with each said positioning notch engageable with a protrusion formed in the plunger cavity in the housing, and a through opening transversely formed in the plunger for thinning a thickness between the through opening and said positioning notches for resiliently engaging each said positioning notch with the protrusion in the plunger cavity.

* * * * *